US006616492B2

(12) United States Patent
Matsuda

(10) Patent No.: US 6,616,492 B2
(45) Date of Patent: Sep. 9, 2003

(54) EXHAUST STRUCTURE OF PERSONAL WATERCRAFT

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/198,430

(22) Filed: Jul. 16, 2002

(65) Prior Publication Data

US 2003/0017759 A1 Jan. 23, 2003

(30) Foreign Application Priority Data

Jul. 23, 2001 (JP) ..... 2001-221574

(51) Int. Cl.[7] ..... B63H 21/32
(52) U.S. Cl. ..... 440/89 F
(58) Field of Search ..... 440/89 R, 89 B, 440/89 C, 89 F

(56) References Cited

U.S. PATENT DOCUMENTS 4,811,560 A * 3/1989 Nakase et al. ..... 60/310
4,997,399 A * 3/1991 Nakayasu et al. ..... 440/89 F
5,647,779 A * 7/1997 Nanami ..... 440/38
6,261,140 B1 * 7/2001 Yoshida et al. ..... 440/88 R

FOREIGN PATENT DOCUMENTS

JP 2000-282840 10/2000

* cited by examiner

*Primary Examiner*—Stephen Avila
(74) *Attorney, Agent, or Firm*—Kolisch Hartwell, P.C.

(57) ABSTRACT

Disclosed is an exhaust structure of a silent jet-propulsion personal watercraft capable of preventing water ingress into an exhaust system even when the watercraft is inverted. An exhaust structure of the watercraft is configured to cause an exhaust gas from an engine for driving a water jet pump to be discharged outside the watercraft through an exhaust passage, the exhaust passage includes a vertically extending water catcher having a substantially closed space in an upper portion thereof; an upstream exhaust passage having one end connected to an exhaust port of the engine and the other end connected to the water catcher at a position below the closed space; and a downstream exhaust passage having one end connected to the water catcher at a position below the closed space and the other end opened to outside of the watercraft.

10 Claims, 7 Drawing Sheets

EXHAUST STRUCTURE OF PERSONAL WATERCRAFT

BACKGROUND OF THE INVENTION

The present invention relates to a jet-propulsion personal watercraft (PWC) which ejects water rearward and planes on a water surface as the resulting reaction. More particularly, the present invention relates to an exhaust structure of the personal watercraft capable of preventing water ingress into an engine when the watercraft is inverted, and of producing a high muffling effect.

In recent years, so-called jet-propulsion personal watercraft have been widely used in leisure, sport, rescue activities, and the like. The personal watercraft is configured to have a water jet pump that pressurizes and accelerates water sucked from a water intake generally provided on a hull bottom surface and ejects it rearward from an outlet port. Thereby, the personal watercraft is propelled.

In general, in the personal watercraft, an exhaust gas from an engine for driving the water jet pump is lead to an exhaust outlet provided in a transom board through an exhaust passage including a water muffler and discharged outside the watercraft from the exhaust outlet.

The water muffler has an internal structure called "labyrinth structure," capable of preventing water entering through the exhaust outlet from reaching the engine, even when the watercraft is inverted. Such a structure is especially advantageous because waves following the watercraft sometimes enter the exhaust outlet when the watercraft is inverted. In particular, in the personal watercraft with a four-cycle engine, the water ingress into the engine sometimes affects an engine power characteristic, and, therefore, it is essential that the water ingress into the engine be prevented.

Under the circumstances, Japanese Laid-Open Patent Application Publication No. 2000-282840 discloses an exhaust structure, in which a water catcher constituted by an inverted-U shaped pipe is connected to downstream of the water muffler and an exhaust gas is discharged outside the watercraft through the water catcher, thereby allowing water flowing back from the exhaust outlet to be reserved in the water catcher when the watercraft is inverted. Thus, water ingress into the engine can be effectively subdued.

However, the water catcher used in the above-mentioned exhaust structure is constituted by the U-shaped pipe manufactured from rubber exclusively for the water catcher. This is unfavorable because the manufacture of the water catcher is time-consuming which would lead to an increased manufacturing cost.

SUMMARY OF THE INVENTION

The present invention addresses the above-described condition, and an object of the present invention is to provide an exhaust structure of a jet-propulsion personal watercraft capable of subduing water ingress into an engine even when the watercraft is inverted, and of producing a high muffling effect, the exhaust structure being capable of suppressing manufacturing time and cost.

In accordance with the present invention, there is provided an exhaust structure of a personal watercraft adapted to eject water pressurized and accelerated by a water jet pump from an outlet port so as to be propelled as the resulting reaction, the exhaust structure being configured to cause an exhaust gas from an engine for driving the water jet pump to be discharged outside the watercraft through an exhaust passage, wherein the exhaust passage includes: a vertically extending water catcher having a substantially closed space in an upper portion thereof; an upstream exhaust passage having one end connected to an exhaust port of the engine and the other end connected to the water catcher at a position below the closed space; and a downstream exhaust passage having one end connected to the water catcher at a position below the closed space and the other end being opened to outside of the watercraft.

With this structure, when the watercraft is inverted, the vertically extending water catcher allows the water flowing in from the exhaust outlet opened to outside of the watercraft to be reserved in the upper portion thereof, thereby subduing the water ingress into the upper exhaust passage of the exhaust passage and the engine. In addition, since the water catcher has a relatively large capacity so as to function as a so-called "expansion chamber," a greater muffling effect can be produced.

In the invention, the downstream exhaust passage is connected to the lower end of the water catcher and the upstream exhaust passage is connected to the water catcher at a position higher than the connected position of the downstream exhaust passage. Such constitution makes it difficult that the water flowing in from the outside of the watercraft through the downstream exhaust passage enters into the upstream exhaust passage, while the watercraft is at its normal posture other than when it is inverted.

The exhaust gas from the water catcher may be discharged from the transom board at the stern of the watercraft by suitably bending the lower end of the water catcher to the rearward, or otherwise discharged outside the watercraft by connecting a suitable passage to the lower end of the water catcher.

Preferably, the upstream exhaust passage may include a water muffler, and an exhaust outlet of the water muffler may be positioned higher than the waterline of the watercraft. Such constitution also advantageously makes it difficult for the water to enter an upstream portion of the water muffler from the outside of the watercraft. Further, in the case of the water muffler having a labyrinth structure, the water entering the water muffler in the upstream exhaust passage is prevented from further entering the engine because of the structure, and the water reserved in the water muffler can be discharged outside the watercraft later, together with the exhaust gas from the engine.

Preferably, the water muffler may be placed at a downstream end section of the upstream exhaust passage which is located apart from the engine and subsequently connected to the water catcher.

Preferably, the water catcher may be adapted to discharge cooling water inside thereof at a position higher than the position where the water catcher is connected to the upstream exhaust passage, thus achieving so-called "wet exhaust" in which the exhaust gas inside of the water catcher is directly cooled by the cooling water.

In the invention, the water catcher may be constituted such that it includes a vertically extending outer member having a substantially closed space and an inner member provided in the closed space of the outer member so as to be apart from the outer member, and the outer member is connected to the downstream exhaust passage and the inner member is connected to the upstream exhaust passage.

It should be appreciated that the outer member and the inner member need not be completely separated as mentioned above. The outer member and the inner member should at least be constituted so as to provide a flowing space of the exhaust gas between the members. Therefore, the outer member and the inner member may be partially in contact with each other, or otherwise may be integrally formed.

Preferably, the upper end of the outer member may be sealed by a separate cap which is independently constructed from the main part of the outer member.

Preferably, the upper end face of the outer member, such as the cap, may be outwardly protruded. With this structure, the water dripping from the upper end face into the top opening of the inner pipe can be inhibited when the inverted watercraft is raised back up and the water reserved in the outer member is effectively discharged outside the watercraft.

Preferably, the upper end face of the outer member, such as the cap, may have a double-walled structure. With this structure, the vibration noise of the end face caused by the oscillating exhaust gas can be inhibited.

In the present invention, as a matter of course, the engine may be a two-cycle engine or a four-cycle engine.

The above and further objects and features of the invention will more fully be apparent from the following detailed description with accompanying drawings.

DETAILED DESCRIPTION OF THE PREFERRED EMBODIMENTS

The present invention will now be described in detail referring to the accompanying drawings illustrating embodiments thereof.

Embodiment 1

Figure 1:
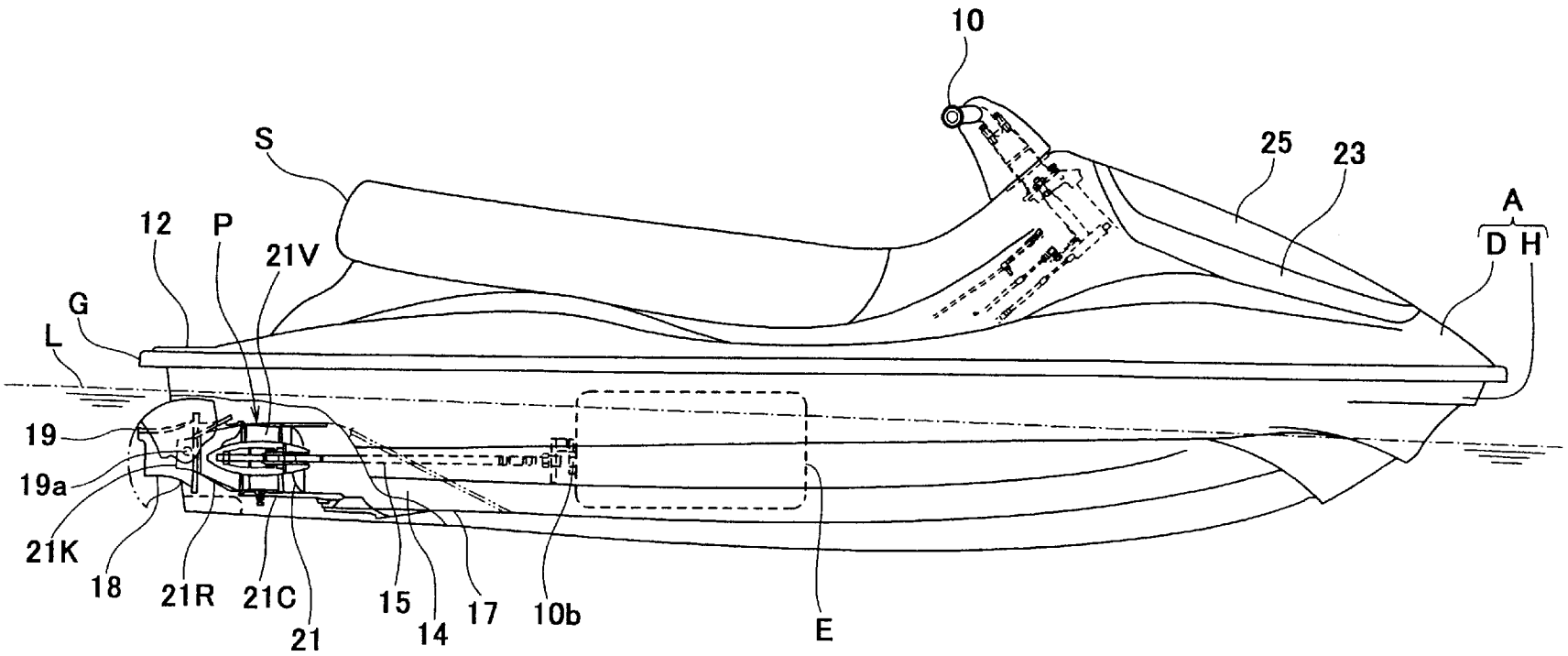
FIG. 1 is a side view showing an entire personal watercraft according to embodiments of the present invention.
Figure 2:
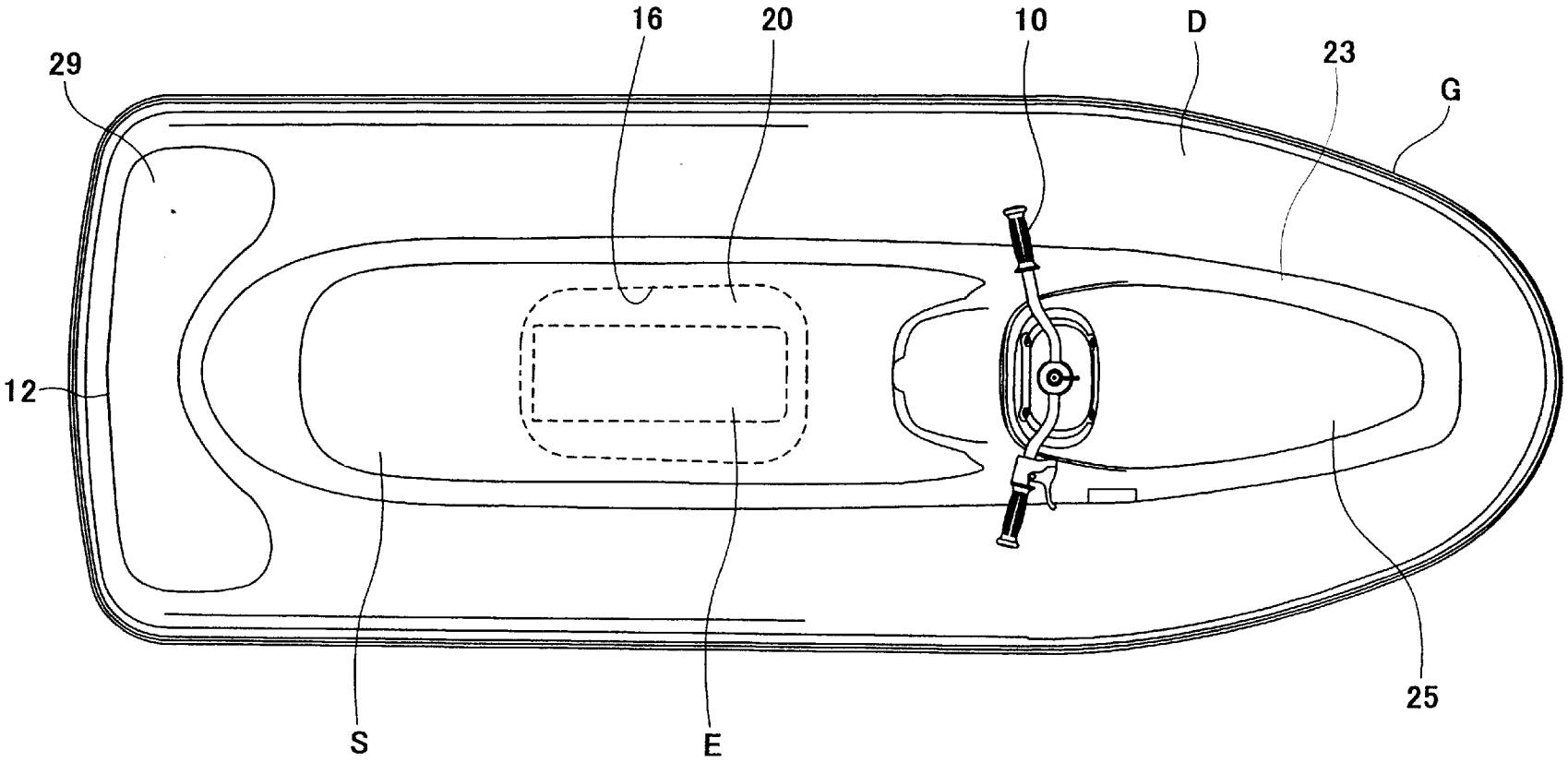
FIG. 2 is a plan view showing the entire personal watercraft of FIG. 1.

FIG. 1 is a side view showing an entire personal watercraft according to a first embodiment of the present invention, and FIG. 2 is a plan view thereof. In FIGS. 1 and 2, reference numeral A denotes a body of the personal watercraft. The body A comprises a hull H and a deck D covering the hull H from above. A line at which the hull H and the deck D are connected over the entire perimeter thereof is called a gunnel line G. In this embodiment, the gunnel line G is located above a waterline L of the personal watercraft.

As shown in FIG. 2, an opening 16, which has a substantially rectangular shape seen from above, is formed at a relatively rear section of the deck D such that it extends in the longitudinal direction of the body A, and a riding seat S is provided over the opening 16. An engine E is provided in a chamber (engine room) 20 surrounded by the hull H and the deck D below the seat S.

The engine E has multiple cylinders (e.g., three cylinders). As shown in FIG. 1, a crankshaft 10*b* of the engine E is mounted along the longitudinal direction of the body A. An output end of the crankshaft 10*b* is rotatably coupled integrally with a pump shaft of a water jet pump P through a propeller shaft 15. An impeller 21 is attached on the pump shaft of the water jet pump P. The impeller 21 is covered with a pump casing 21C on the outer periphery thereof.

A water intake 17 is provided on the bottom of the hull H. The water is sucked from the water intake 17 and fed to the water jet pump P through a water intake passage 14. The water jet pump P pressurizes and accelerates the water by rotation of the impeller 21. The pressurized and accelerated water is discharged through a pump nozzle 21R having a cross-sectional area of flow gradually reduced rearward, and from an outlet port 21K provided on the rear end of the pump nozzle 21R, thereby obtaining a propulsion force. In FIG. 1, reference numeral 21V denotes fairing vanes for fairing water flow behind the impeller 21.

As shown in FIGS. 1 and 2, reference numeral 10 denotes a bar-type steering handle. The handle 10 operates in association with a steering nozzle 18 swingable around a swing shaft (not shown) to the right or to the left behind the pump nozzle 21R. When the rider rotates the handle 10 clockwise or counterclockwise, the steering nozzle 18 is swung toward the opposite direction so that the watercraft can be correspondingly turned to a steered direction while the water jet pump P is generating the propulsion force.

As shown in FIG. 1, a bowl-shaped reverse deflector 19 is provided above the rear side of the steering nozzle 18 such that it can swing downward around a horizontally mounted swinging shaft 19*a*. The deflector 19 is swung downward to a lower position behind the steering nozzle 18 to deflect the ejected water from the steering nozzle 18 forward, and as the resulting reaction, the personal watercraft moves rearward.

In FIGS. 1 and 2, reference numeral 12 denotes a rear deck. The rear deck 12 is provided with an openable rear hatch cover 29. A rear compartment (not shown) with a small capacity is provided under the rear hatch cover 29. In FIGS. 1 and 2, reference numeral 23 denotes a front hatch cover. A front compartment (not shown) is provided under the front hatch cover 23 for storing equipment and the like. Another hatch cover 25 is provided over the front hatch cover 23 forming a two-layer hatch cover. Life jackets or the like can be stored under the upper hatch cover 25 through an opening (not shown) provided in the rear end thereof.

Figure 3:
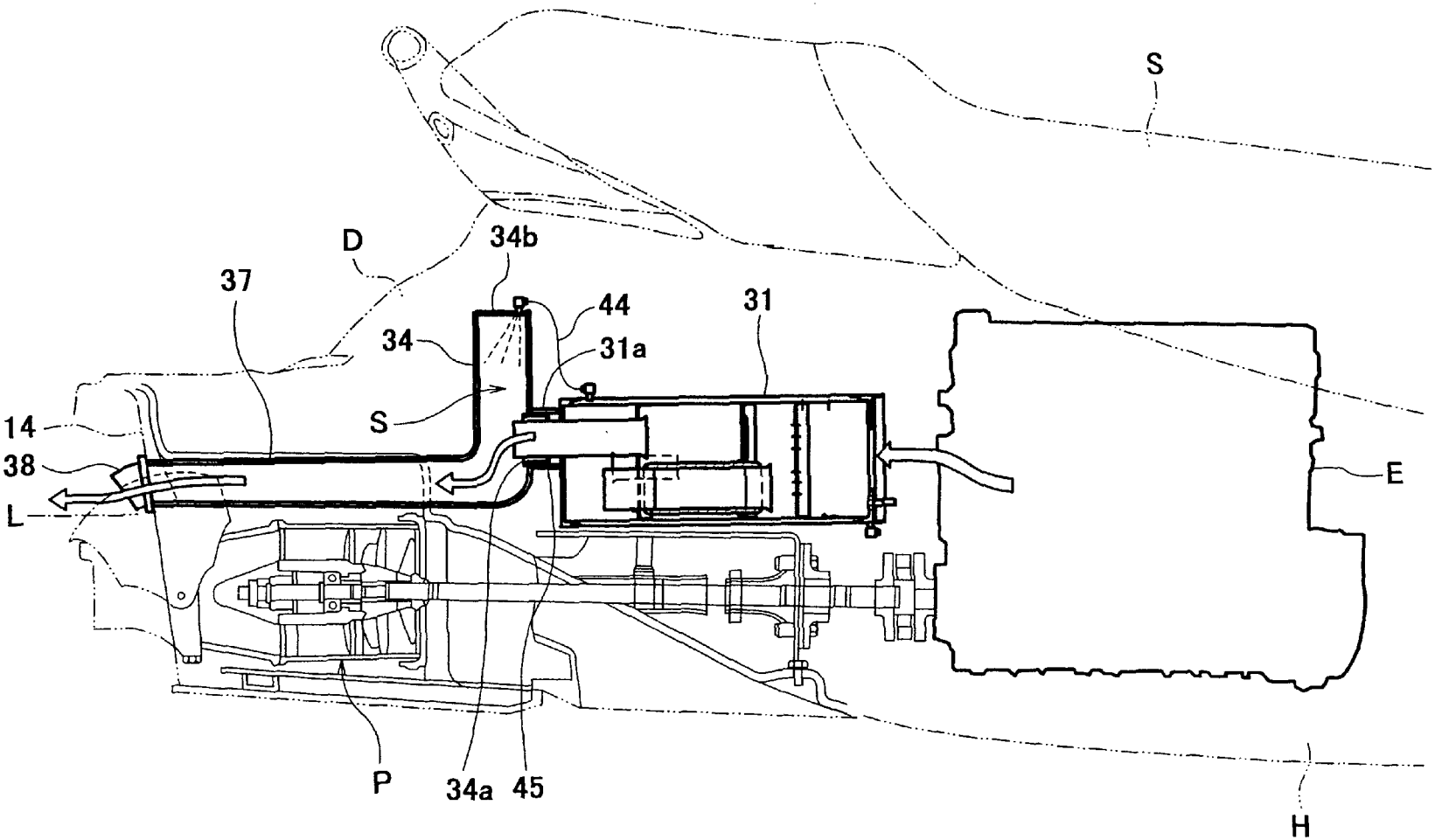
FIG. 3 is a perspective side view showing main components of an exhaust structure of the personal watercraft according to a first embodiment of the present invention.

FIG. 3 is a perspective side view showing main components of an exhaust structure of the personal watercraft according to the embodiments of the present invention. As indicated by arrows in FIG. 3, the exhaust gas from the engine E is discharged outside the watercraft through an exhaust passage including a water muffler 31, a water catcher 34, and so on.

For detail, the exhaust passage is comprised of the water catcher 34, an upstream exhaust passage for connecting an exhaust port (not shown) of the engine E to the water catcher 34 at an upperstream position of the water catcher 34 in an exhaust gas flow path, and a downstream exhaust passage for connecting the water catcher 34 to an exhaust outlet 38 through which the exhaust gas is discharged outside, at a downstream position of the water catcher 34.

The exhaust gas from the engine E is introduced into the water muffler 31 through an exhaust manifold (not shown) constituting the upstream exhaust passage and muffled in the water muffler 31 having an internal labyrinth structure. Then, the muffled exhaust gas is introduced into the water catcher 34 through a connecting port 31*a* projected from a rear end face of the water muffler 31.

The water catcher 34 is manufactured mainly from a stainless-steel straight pipe and its longitudinal direction corresponds with the vertical direction of the watercraft. The upper end of the water catcher 34 is sealed by a cap 34*b*, thereby forming a substantially closed space S. The water catcher 34 is provided with a connecting port 34*a* at a predetermined position in the longitudinal (vertical) direction. The connecting port 34*a* has a diameter substantially equal to that of the connecting port 31*a* of the water muffler 31. The connecting port 34*a* is fitted and fastened to the connecting port 31*a* of the water muffler 31 by means of a connecting band 45.

While the exhaust gas is introduced to the water catcher 34 by what is referred to as "dry exhaust" herein, it will also be appreciated that so-called "wet exhaust" shown in FIG. 3 may be employed, in which the outer wall of the water muffler 31 has a double-walled structure for allowing cooling water to flow inside thereof, thereby forming a water jacket in the water muffler 31, and the cooling water in this water jacket is discharged from the upper end of the water catcher 34 to the inside of the water catcher 34 through a suitable cooling water passage 44. Preferably, the cooling water is discharged at a position higher than the connecting port 31*a* of the water muffler 31. More preferably, as shown in FIG. 3, the cooling water is discharged inside of the water catcher 34 from the upper end of the water catcher 34.

In this embodiment, the lower end of the water catcher 34 is bent at a right angle toward the rear side of the watercraft to form a connecting passage 37 leading to an exhaust outlet 38 provided in an outer face of the transom board. In order to use an inexpensive pipe as the water catcher 34, the lower end of the water catcher 34 may be connected to the connecting passage 37 by any suitable connecting means.

In general, the exhaust outlet 38 is located immediately above the waterline L indicated by a dashed line in FIG. 3. In this embodiment, the water muffler 31 is connected to the water catcher 34 at a position slightly higher than the exhaust outlet 38. This constitution is capable of preventing the water from entering into the water muffler 31 and further into the engine E through the exhaust outlet 38 while the watercraft is at its normal posture (in stopping or cruising state).

On the other hand, when the watercraft is inverted, the water entering through the exhaust outlet 38 is reserved in the closed space S in an upper portion of the water catcher 34 and does not flow into the water muffler 31 until the reserved water reaches the connecting port 31*a*. When the inverted watercraft is raised up, the water reserved in the closed space S in the upper portion of the water catcher 34 flows back to the exhaust outlet 38 and is discharged outside the watercraft.

Embodiment 2

Figure 4:
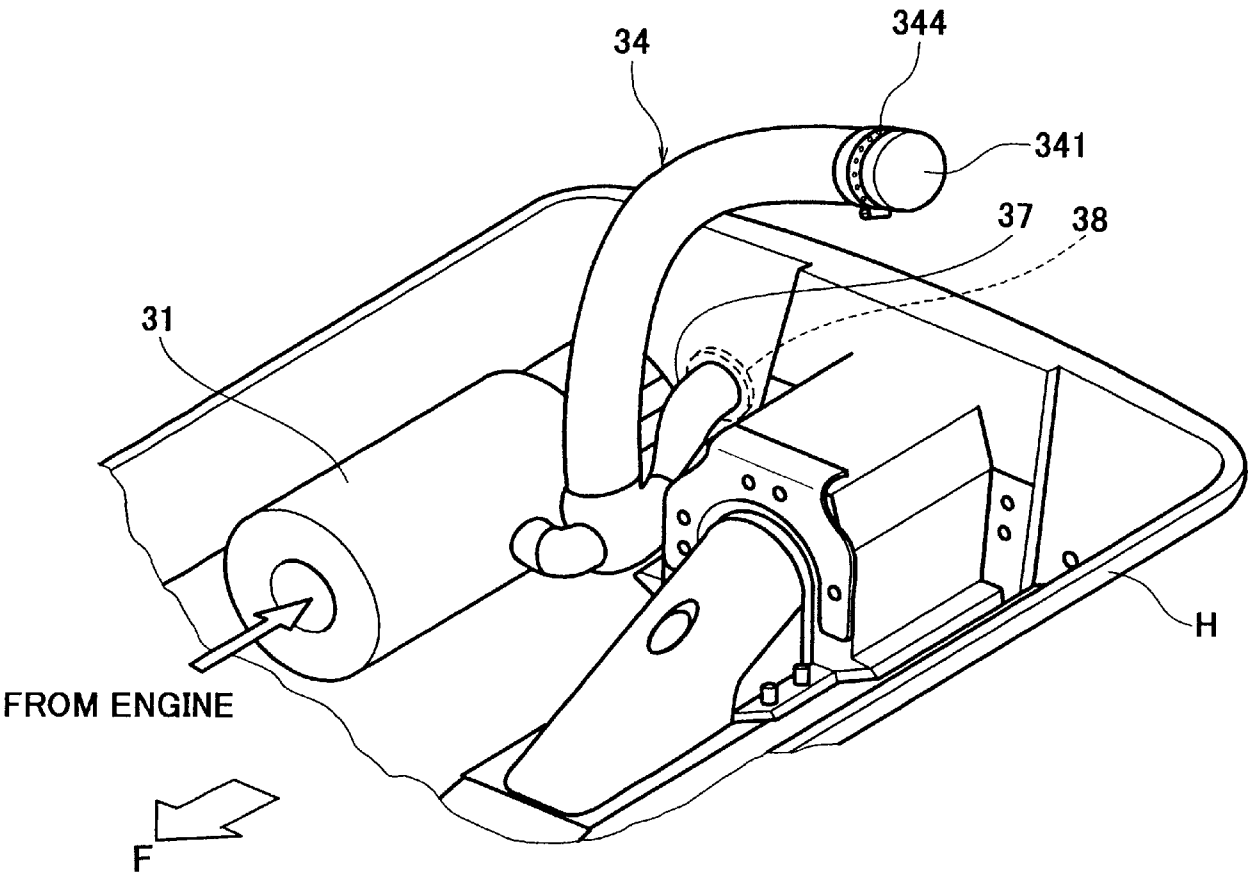
FIG. 4 is a perspective view from front-left side of the watercraft, showing arrangement of a water muffler and a water catcher of the personal watercraft according to a second embodiment of the present invention.
Figure 5:
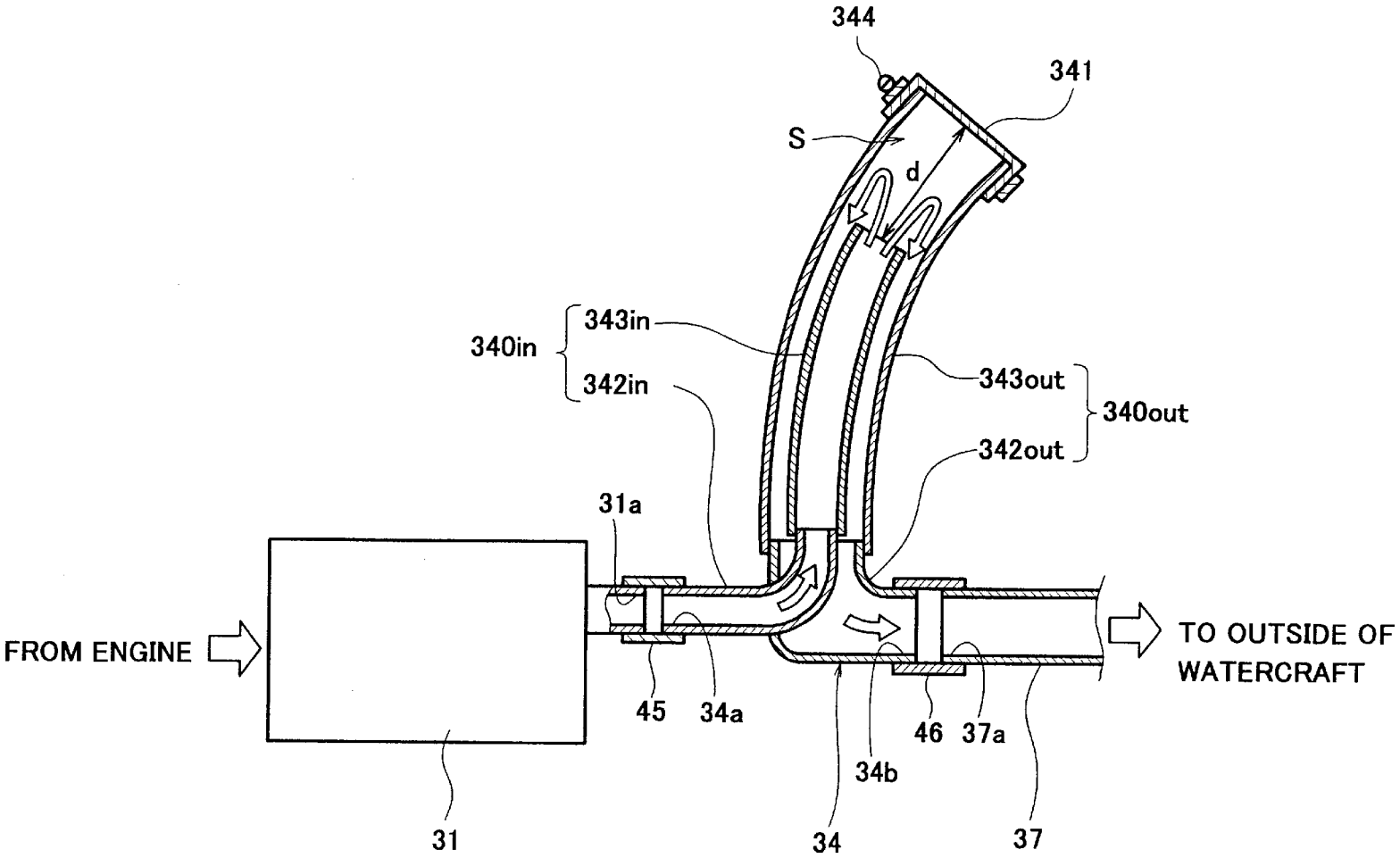
FIG. 5 is a partly schematic, longitudinal sectional view of the water muffler and the water catcher shown in FIG. 4.

FIG. 4 is a perspective view from the front left side of the watercraft, showing arrangement of a water muffler and a water catcher according to the second embodiment of the present invention. In FIG. 4, "F" indicates the front side of the watercraft. FIG. 5 is a longitudinal sectional view showing main components of the water of FIG. 4.

As indicated by an arrow in FIG. 4, the exhaust gas from the engine E flows through the water muffler 31 constituting the upstream exhaust passage and then flows into the water catcher 34 through the connecting port 31 a provided on the side (left side in FIG. 4) of the water muffler 31. Then, the exhaust gas flows into the connecting passage 37 constituting the downstream exhaust passage through the water catcher 34 and is discharged outside the watercraft through the exhaust outlet 38 on the rear side of the watercraft. While in this embodiment, the connecting port 31*a* is provided in the side face of the water muffler 31, this may be alternatively provided on the rear side similarly to the first embodiment.

Referring to FIG. 5, the water catcher 34 of this embodiment has a double-pipe structure in which an inner pipe $\mathbf{340}_{in}$ as an inner member is inserted into an inner space of an outer pipe $\mathbf{340}_{out}$ as an outer member (outer shell) so as to be spaced apart from each other. The outer pipe $\mathbf{340}_{out}$ vertically extends and its upper end is sealed, thereby forming the substantially closed space S in the upper portion of the water catcher 34.

The outer pipe $\mathbf{340}_{out}$ is comprised of a straight pipe $\mathbf{343}_{out}$ located on the upper side and a bend pipe (elbow pipe) $\mathbf{342}_{out}$ located on the lower side. The inner pipe $\mathbf{340}_{in}$ is comprised of a straight pipe $\mathbf{343}_{in}$ located on the upper side and a bend pipe (elbow pipe) $\mathbf{342}_{in}$ located on the lower side. The straight pipes $\mathbf{343}_{out}$, $\mathbf{343}_{in}$ are made of rubber and the bend pipes (elbow pipes) $\mathbf{342}_{out}$, $\mathbf{342}_{in}$ are made of metal. The water catcher 34 is configured such that the inner straight pipe $\mathbf{343}_{in}$ is connected to the connecting port 31*a* of the water muffler 31 at a connecting port 34*a* of the bend pipe $\mathbf{342}_{in}$ through the bend pipe $\mathbf{342}_{in}$ and the outer straight pipe $\mathbf{343}_{out}$ is connected to a connecting port 37*a* of the connecting passage 37 constituting the downstream exhaust passage at a connecting port 34*b* of the bend pipe $\mathbf{342}_{out}$ through the bend pipe $\mathbf{342}_{out}$ and further connected to the exhaust outlet 38 at the rear side of the watercraft through the connecting passage 37.

Figure 6:
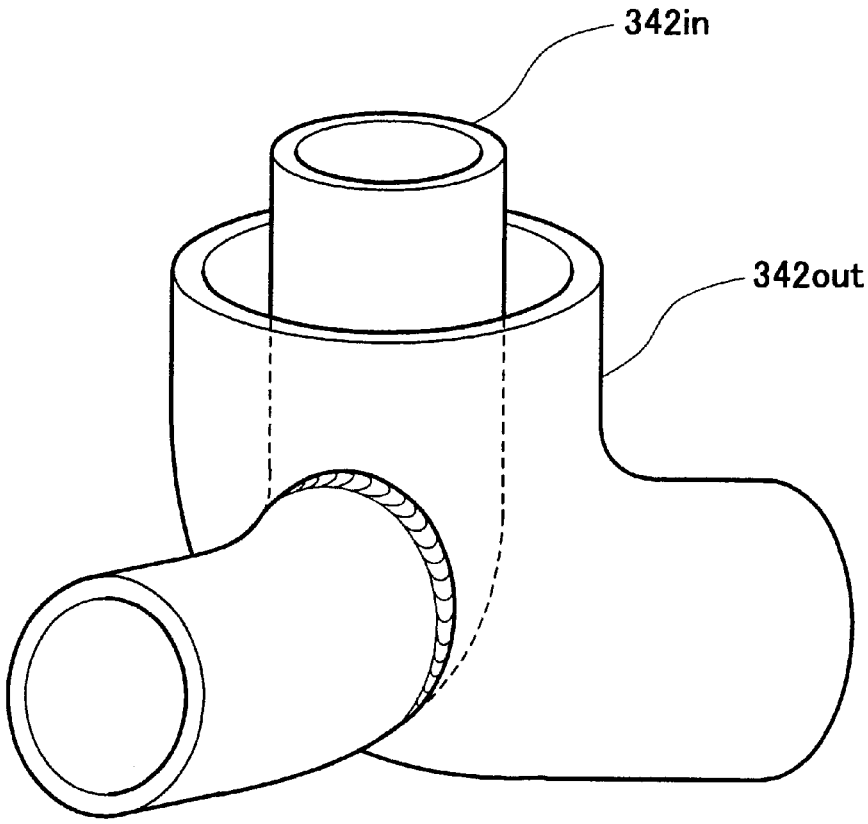
FIG. 6 is a perspective view showing a structure of bend pipes constituting a water catcher according to the second embodiment.

As shown in FIG. 6, commercially available pipes are used as the bend pipes $\mathbf{342}_{out}$, $\mathbf{342}_{in}$ and are combined in the following manner. A hole is formed in an outer curved face of the outer bend pipe $\mathbf{342}_{out}$ which has a diameter equal to an outer diameter of the inner bend pipe $\mathbf{342}_{in}$, and the inner bend pipe $\mathbf{342}_{in}$ is inserted through the hole. The bend pipe $\mathbf{342}_{in}$ is fixed to the bend pipe $\mathbf{342}_{out}$ from outside by welding. The bend pipes $\mathbf{342}_{out}$, $\mathbf{342}_{in}$ are not limited to the elbow pipes as described above, but bend pipes having a larger radius of curvature may be used.

Referring to FIG. 5 again, the upper end of the inner bend pipe $\mathbf{342}_{in}$ projects upwardly so as to be higher than the upper end of the outer bend pipe $\mathbf{342}_{out}$. The inner straight pipe $\mathbf{343}_{in}$ is fitted to the upper end of the inner bend pipe $\mathbf{342}_{in}$, and then the outer straight pipe $\mathbf{343}_{out}$ is fitted to the upper end of the outer bend pipe $\mathbf{342}_{out}$. Commercially available pipes may be used as the straight pipes $\mathbf{343}_{out}$, $\mathbf{343}_{in}$, but specially designed ones may be used for the sake of optimized shape.

In FIG. 5, the upper portions of the straight pipes $\mathbf{343}_{out}$, $\mathbf{343}_{in}$ are rearwardly curved. This is due to the fact that the commercially available pipes made of rubber are originally curved. The functions and effects of the present invention can be obtained regardless of such curves.

The straight pipes $\mathbf{343}_{out}$, $\mathbf{343}_{in}$ are sized so that the upper end of the outer straight pipe $\mathbf{343}_{out}$ extends upwardly so as to be higher by predetermined length d than the upper end of the inner straight pipe $\mathbf{343}_{in}$. A metal cap 341 is externally attached to the upper end of the outer straight pipe $\mathbf{343}_{out}$ and fixed thereto by means of a suitable fastening band. While the upper end of the outer straight pipe $\mathbf{343}_{out}$ is sealed by the metal cap 341 separable from the outer straight pipe $\mathbf{343}_{out}$ in this embodiment, the straight pipe $\mathbf{343}_{out}$ and the cap 341 may be integrally formed.

In the water catcher 34 so constituted, as indicated by arrows in FIG. 5, the exhaust gas from the water muffler 31 first flows into the inner bend pipe $\mathbf{342}_{in}$ and is discharged from the upper end of the inner straight pipe $\mathbf{343}_{in}$ into the outer straight pipe $\mathbf{343}_{out}$. In this case, since the exhaust gas is discharged from the small-diameter inner straight pipe $\mathbf{343}_{in}$ into the large-diameter outer straight pipe $\mathbf{343}_{out}$, its exhaust pressure and exhaust noise are reduced. The exhaust gas discharged into the outer straight pipe $\mathbf{343}_{out}$ out flows downwardly inside of the outer straight pipe $\mathbf{343}_{out}$, and is led to the outer bend pipe $\mathbf{342}_{out}$ and the connecting passage 37 connected to the outer bend pipe $\mathbf{342}_{out}$ by the connecting band 46, and then is discharged from the exhaust outlet 38 (see FIG. 4).

While the watercraft is at its normal posture (in stopping or cruising state), the water flowing into exhaust outlet 38 from outside flows into the outer straight pipe $\mathbf{343}_{out}$ through the connecting passage 37 and the outer bend pipe $\mathbf{342}_{out}$, but such water does not flow into the inner straight pipe $\mathbf{343}_{in}$ until the water reaches the upper opening end of the inner straight pipe $\mathbf{343}_{in}$. Therefore, the water ingress into the water muffler 31, and hence into the engine E, is prevented.

On the other hand, when the watercraft is inverted, the water entering through the exhaust outlet 38 flows into the outer straight pipe $\mathbf{343}_{out}$ through the connecting passage 37 and the outer bend pipe $\mathbf{342}_{out}$, but such water is reserved in the closed space S in the upper portion of the water catcher 34 and does not flow into the water muffler 31 until the water reach the connecting port 31*a* of the water muffler 31. Thereafter, when the watercraft is raised back up, the water reserved in the outer straight pipe $\mathbf{343}_{out}$ flows back to the exhaust outlet 38 through the outer bend pipe $\mathbf{342}_{out}$ and the connecting passage 37 and is discharged outside the watercraft. In this case, the water in the inner straight pipe $\mathbf{342}_{in}$ and a part of the water in the outer straight pipe $\mathbf{343}_{out}$ might flow into the water muffler 31, but such amount of water is small and can be captured in the water muffler 31 and prevented from flowing into the engine E. Upon re-starting of the engine E, the captured water is discharged outside the watercraft, together with the exhaust gas.

The muffling effect of the water catcher 34 of this embodiment is adjustable depending on various conditions, including material of the water catcher 34, and the diameter and thicknesses of the outer straight pipe $\mathbf{343}_{out}$ and inner straight pipe $\mathbf{343}_{in}$. For example, these conditions may be set based on the water inflow, and the above-identified predetermined length d, equal to the difference in upper ends between the outer straight pipe $\mathbf{343}_{out}$ and the inner straight pipe $\mathbf{343}_{in}$, is adjustable based on observation of actual muffling effect. In this embodiment, such adjustment is easily achieved because the outer straight pipe $\mathbf{343}_{out}$ and the inner straight pipe $\mathbf{343}_{in}$ are made of rubber.

Figure 7A:
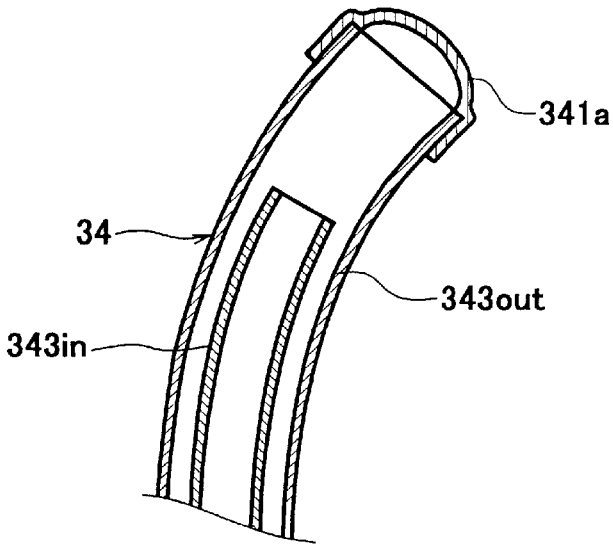
FIGS. 7A and 7B are longitudinal sectional views of main components of the water catcher according to the second embodiment, showing configurations of caps for sealing an upper end of an outer pipe of the water catcher.

FIG. 7A shows an alternative embodiment of the cap, in which a center part of a cap 341*a* is protruded outwardly in the shape of bowl. Such a shape is helpful in subduing the dripping of the water reserved in the outer straight pipe $\mathbf{343}_{out}$ into the inner straight pipe $\mathbf{343}_{in}$ when the inverted watercraft is raised back up.

Figure 7B:
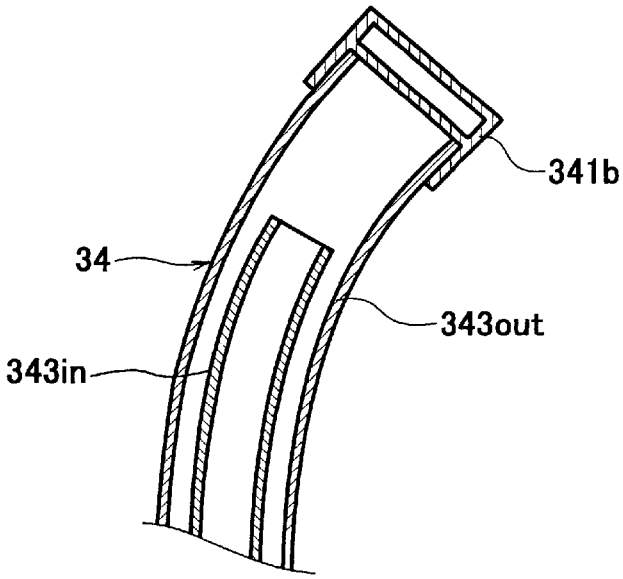

FIG. 7B shows a cap 341*b* having an end face portion with a double-walled structure. Such a shape can subdue a noise generated by the vibration of the end face portion of the cap 341*b*, which is caused by the exhaust gas.

The cap 341*a* in FIG. 7A may have the double-walled structure similar to that shown in FIG. 7B. In this case, an inner side wall of the cap 341*a* may be formed in the shape of punching metal, woven metal wires, and the like. With such configuration, since a space between the outer and inner walls functions as a so-called "resonance chamber" of the exhaust gas, a greater muffling effect is attained.

Moreover, while in this embodiment, the upper portion of the outer pipe $\mathbf{340}_{out}$ (straight pipe $\mathbf{343}_{out}$) as the outer member of the water catcher 34 and the upper portion of the inner pipe $\mathbf{340}_{in}$ (straight pipe $\mathbf{343}_{in}$) as the inner member are straight pipes, combination of various shapes, e.g., a spherical outer pipe $\mathbf{340}_{out}$ and a straight inner pipe $\mathbf{340}_{in}$, may be employed.

The other constitutions and functions of this embodiment are similar to those of the first embodiment, and similar or corresponding parts are identified by the same reference numerals and will not be further described.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within the metes and bounds of the claims, or equivalents of such metes and bounds thereof are therefore intended to be embraced by the claims.

What is claimed is:

1. A personal watercraft comprising:

a water jet pump including an outlet port, the water jet pump pressurizing and accelerating water taken in from outside of the watercraft and ejecting the water from the outlet port to propel the watercraft as a reaction of the ejecting water;

an engine for driving the water jet pump; and an exhaust passage connected to an exhaust port of the engine, for discharging an exhaust gas from the engine to outside of the watercraft, wherein the exhaust passage includes:

a water catcher extending vertically and having a substantially closed space in an upper portion thereof;

an upstream exhaust passage having one end connected to the exhaust port of the engine and the other end connected to the water catcher at a position below the closed space; and a downstream exhaust passage having one end connected to the water catcher at a position below the closed space and the other end being opened to outside of the watercraft.

2. The personal watercraft according to claim 1, wherein the downstream exhaust passage is connected to a lower end of the water catcher and the upstream exhaust passage is connected to the water catcher at a position above the lower end of the water catcher which is connected to the downstream exhaust passage.

3. The personal watercraft according to claim 2, wherein the upstream exhaust passage includes a water muffler and an exhaust outlet of the water muffler is located higher than a waterline of the watercraft.

4. The personal watercraft according to claim 3, wherein the water muffler constitutes a downstream end portion of the upstream exhaust passage and is subsequently connected to the water catcher.

5. The personal watercraft according to claim 1, wherein the water catcher is configured such that cooling water is discharged to the inside of the water catcher at a position above a portion where the water catcher is connected to the upstream exhaust passage.

6. The personal watercraft according to claim 1, wherein the water catcher includes:

an outer member vertically extending and having the closed space; and an inner member provided in the closed space of the outer member so as to be spaced apart from the outer member, wherein the outer member is connected to the downstream exhaust passage and the inner member is connected to the upstream exhaust passage.

7. The personal watercraft according to claim 6, wherein the outer member is comprised of a pipe-shaped member having a sealed upper end and connected at a lower end to the downstream exhaust passage, and the inner member is comprised of a pipe-shaped member and penetrates through the outer member to be connected to the upstream exhaust passage.

8. The personal watercraft according to claim 7, wherein an upper end of the outer member is sealed by a cap separable from the water catcher.

9. The personal watercraft according to claim 7, wherein an upper end face of the outer member is outwardly protruded.

10. The personal watercraft according to claim 7, wherein an upper end face of the outer member has a double-walled structure.

* * * * *